US009759503B2

(12) United States Patent
Huang

(10) Patent No.: US 9,759,503 B2
(45) Date of Patent: Sep. 12, 2017

(54) CARTRIDGE LOADING MECHANISM OF TOY REVOLVER

(71) Applicant: Kien Well Toy Industrial Co., Ltd., Tainan (TW)

(72) Inventor: Shun-Chi Huang, Tainan (TW)

(73) Assignee: Kien Well Toy Industrial Co., Ltd., Tainan (TW)

( * ) Notice: Subject to any disclaimer, the term of this patent is extended or adjusted under 35 U.S.C. 154(b) by 81 days.

(21) Appl. No.: 14/956,626

(22) Filed: Dec. 2, 2015

(65) Prior Publication Data

US 2017/0160029 A1 Jun. 8, 2017

(51) Int. Cl.

| | |
|---|---|
| ***F41B 11/00*** | (2013.01) |
| ***F41A 9/27*** | (2006.01) |
| ***F41C 3/00*** | (2006.01) |
| ***F41B 11/54*** | (2013.01) |
| ***F41A 9/73*** | (2006.01) |
| *F41B 11/89* | (2013.01) |

(52) U.S. Cl.

CPC *F41A 9/27* (2013.01); *F41A 9/73* (2013.01); *F41B 11/54* (2013.01); *F41C 3/005* (2013.01); *F41B 11/89* (2013.01)

(58) Field of Classification Search

CPC .. F41B 11/54; F41B 11/89; F41A 9/27; F41A 9/73

USPC ..... 124/48; 42/59, 60

See application file for complete search history.

(56) References Cited

U.S. PATENT DOCUMENTS

| | | | | | |
|---|---|---|---|---|---|
| 2,980,096 | A * | 4/1961 | Merz | F41B 11/51 | 124/36 |
| 3,212,489 | A * | 10/1965 | Merz | F41B 11/54 | 124/36 |
| 3,782,359 | A * | 1/1974 | Kester | F41A 9/85 | 124/48 |
| 4,841,655 | A * | 6/1989 | Ferri | F41B 11/642 | 124/66 |
| 4,848,307 | A * | 7/1989 | Tsao | A63H 27/14 | 124/59 |
| 5,220,115 | A * | 6/1993 | Wales | F41C 3/14 | 42/59 |
| 5,622,160 | A * | 4/1997 | Casas Salva | F41B 11/54 | 124/59 |
| 5,727,345 | A * | 3/1998 | Sullivan | F41A 9/28 | 42/59 |
| 5,787,869 | A * | 8/1998 | Johnson | F41B 11/54 | 124/69 |
| 6,428,384 | B1 * | 8/2002 | Su | F41A 9/73 | 446/473 |
| 6,470,871 | B2 * | 10/2002 | Casas-Salva | F41B 11/54 | 124/48 |

(Continued)

*Primary Examiner* — Alexander Niconovich

(74) *Attorney, Agent, or Firm* — Alan D. Kamrath; Kamrath IP Lawfirm, P.A.

(57) ABSTRACT

A cartridge loading mechanism of a toy revolver includes a magazine, a cylinder, a cartridge drum and a driving element. When loading bullets, the cartridge loading mechanism may be removed to load the bullets. When firing a bullet, the cylinder may be rotated to provide a high simulation. When a bullet is fired, the cylinder and the cartridge drum are rotated together, and the magazine disposed in the cylinder and an inner magazine tube remain still and will not rotate with the cylinder, so that the inner magazine tube is aligned precisely with the barrel to improve the shooting accuracy.

8 Claims, 9 Drawing Sheets

(56) References Cited

U.S. PATENT DOCUMENTS

| | | | | |
|---|---|---|---|---|
| 6,502,568 | B2 * | 1/2003 | Kunimoto | F41B 11/54 124/48 |
| 7,159,584 | B2 * | 1/2007 | Maeda | F41B 11/62 124/41.1 |
| 7,458,371 | B2 * | 12/2008 | Ong | F41B 11/54 124/59 |
| 7,963,280 | B2 * | 6/2011 | Maeda | F41A 9/73 124/45 |
| 8,146,579 | B2 * | 4/2012 | Jablonski | F41B 11/54 124/65 |
| 8,875,689 | B2 * | 11/2014 | Chor-Ming | F41A 9/27 124/41.1 |
| 8,875,690 | B2 * | 11/2014 | Chor-Ming | F41A 9/27 124/45 |
| 9,086,252 | B2 * | 7/2015 | Wang | F41B 11/80 |

* cited by examiner (A-A)

(B-B)

CARTRIDGE LOADING MECHANISM OF TOY REVOLVER

BACKGROUND OF THE INVENTION

Field of the Invention

The present invention relates to a cartridge loading mechanism of a toy revolver and, more particularly, to the cartridge loading mechanism with the feature of high simulation and capable of improving shooting accuracy.

Description of the Related Art

In a toy revolver, bullets are generally loaded into a magazine of a cylinder, so that the bullets can be shot continuously without the need of reloading the bullet after each shot. The toy revolver has the feature of rotating the cylinder for one graduation after firing a bullet, and the cylinder and the magazine may be flipped open to load bullets. The conventional toy revolver is mainly divided into the following two main types:

1. With reference to FIG. 1 for a first conventional toy revolver 1*a*, a cylinder 10*a* and a gun body are integrally formed, and the cylinder 10*a* cannot be flipped open. A cartridge drum 12*a* pivoted between the cylinder 10*a* and a barrel 11*a* may be removed to load bullets, and the cartridge drum 12*a* is driven and rotated by a trigger 13*a* to form a cartridge loading mechanism. In the first toy revolver 1*a*, the cartridge drum 12*a* is arranged adjacent to the barrel, and a bullet does not pass through the magazine inside the cylinder 10*a*, so that the bullet has a high shooting accuracy. However, the cylinder 10*a* cannot be flipped to move out from the left side, and, thus, the degree of simulation is low.

2. With reference to FIG. 2 for a second conventional toy revolver 1*b*, a magazine 14*b* is installed in the cylinder 10*b* and rotated and linked with the cylinder 10*b* to define a cartridge loading mechanism. The cylinder 10*b* and the magazine 14*b* may be removed as a whole to the outside and rotated together when the trigger 13*b* is triggered, and, thus, the degree of simulation is high. However, the magazine 14*b* can be rotated, so that it is necessary to align with the barrel 11*b* precisely when the chamber 15*b* of the magazine 14*b* used for loading bullets is rotated for each graduation. Otherwise, the bullet exit in the chamber 15*b* will be deviated from the barrel 11*b* when the bullet is shot. As a result, the trajectory is deviated, and the shot is missed. Obviously, the manufacture requires high precision of connecting the aforementioned components.

In view of the aforementioned drawbacks of the conventional toy revolver, the cartridge loading mechanism of a toy revolver is developed to overcome the drawbacks of the prior art.

SUMMARY OF THE INVENTION

Therefore, it is a primary objective of the present invention to provide a cartridge loading mechanism of a toy revolver with the feature of high simulation and capable of improving shooting accuracy.

To achieve the aforementioned objective, the present invention provides a cartridge loading mechanism comprises a magazine, a cylinder, a cartridge drum and a driving element. The center of the magazine is supported by a support shaft and fixed, such that the magazine will not rotate and is pivotally coupled to an opening at the middle of a gun body. The magazine has an inner magazine tube axially extended from a position of a barrel corresponsive to the gun body, and an end of the inner magazine tube is coupled to the barrel. The cylinder is sheathed on the magazine, and the cylinder has a cylinder center. The cylinder center and the magazine are pivotally coupled to each other by a pivot member, and the cylinder may rotate with the magazine. The cylinder has a containing slot formed at a position near the trigger, and the inner bottom of the containing slot has a plurality of ports arranged circumferentially by using the cylinder center of the cylinder as the center. One of the ports is configured to be corresponsive to the inner magazine tube. The cartridge drum is embedded into the containing slot of the cylinder and has a through hole is formed at the center, and a plurality of chambers is configured to be corresponsive to the ports of the cylinders respectively and extends into the ports, so that the cartridge drum and the cylinder are linked and rotated together. A toy bullet is loaded into each of the chambers. The driving element is embedded into the through hole and includes a drive seat, a drive shaft, and a plurality of bumps formed on a side of the drive seat and corresponsive to the trigger and arranged circumferentially. The bumps are driven by the trigger, and the driving element rotates a predetermined graduation for being driven each time. An end of the drive shaft is coupled to the cylinder center of the cylinder. When the driving element drives the cylinder and the cartridge drum is rotated altogether, the magazine remains still, so that the inner magazine tube is always aligned precisely and coupled with the barrel. Therefore, the cartridge loading mechanism can be removed to load bullets. When a bullet is fired, the cylinder rotates, so that the degree of simulation is high. When a bullet is fired and the cylinder and the cartridge drum rotate, the magazine and the inner magazine tube always remain still, and the inner magazine tube is aligned precisely with the barrel, so that the shooting accuracy can be improved.

DETAILED DESCRIPTION OF THE PREFERRED EMBODIMENTS

The technical characteristics, contents, advantages and effects of the present invention will be apparent with the detailed description of preferred embodiments accompanied with related drawings as follows.

Figure 1:
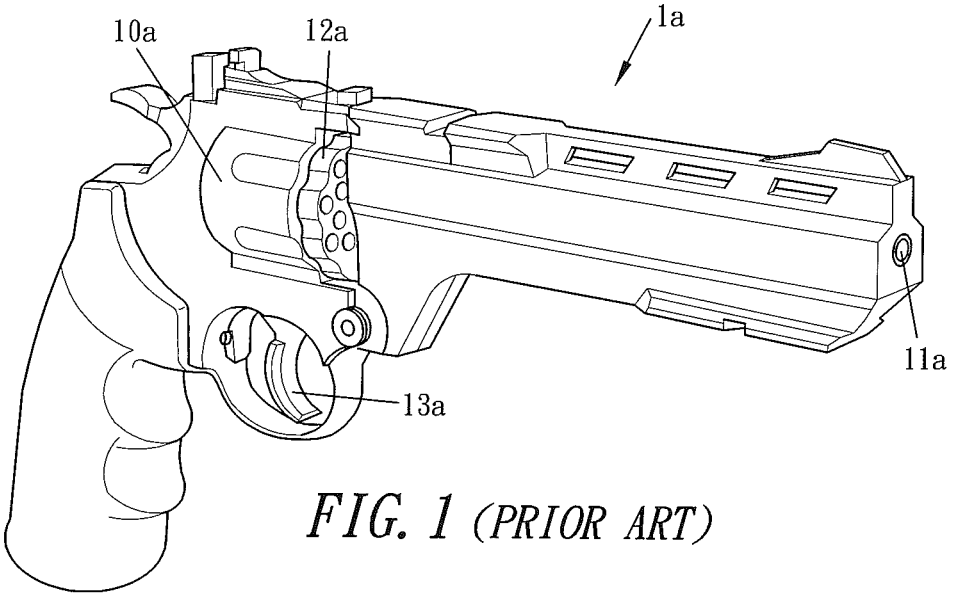
FIG. 1 (PRIOR ART)
FIG. 1 is a perspective view of a first conventional toy revolver.
Figure 2:
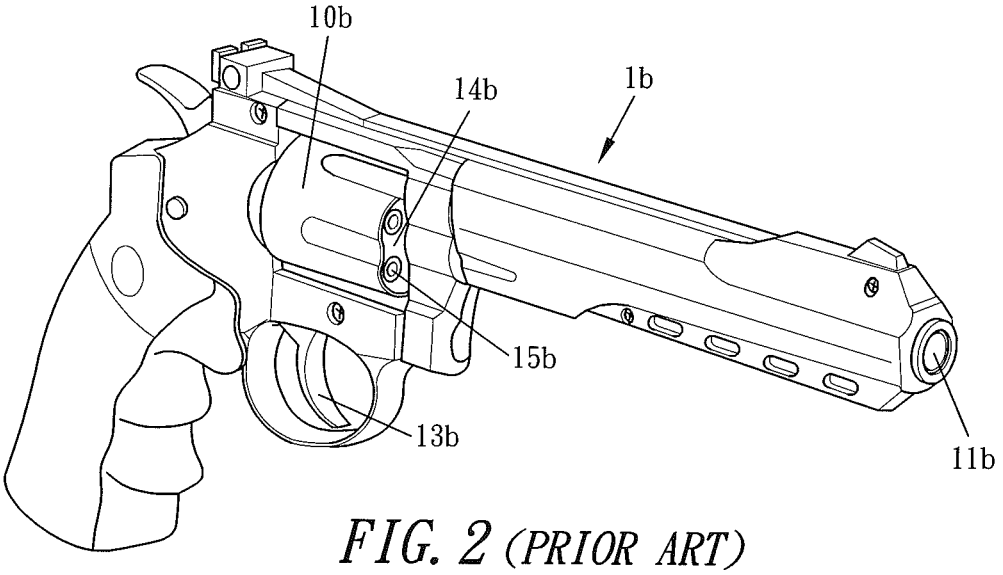
FIG. 2 (PRIOR ART)
FIG. 2 is a perspective view of a second conventional toy revolver.
Figure 3:
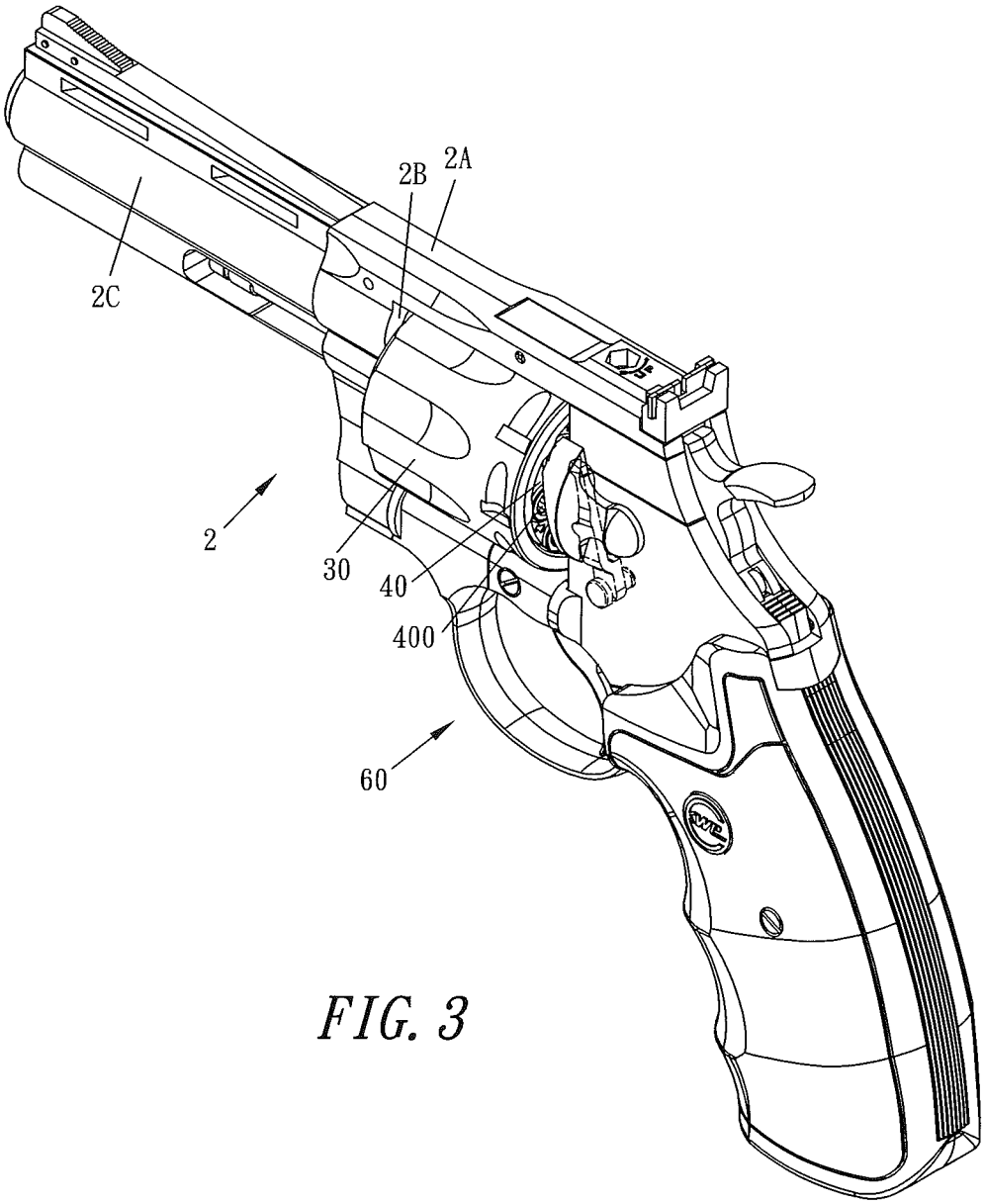
FIG. 3 is a perspective view of a preferred embodiment of the present invention.
Figure 4:
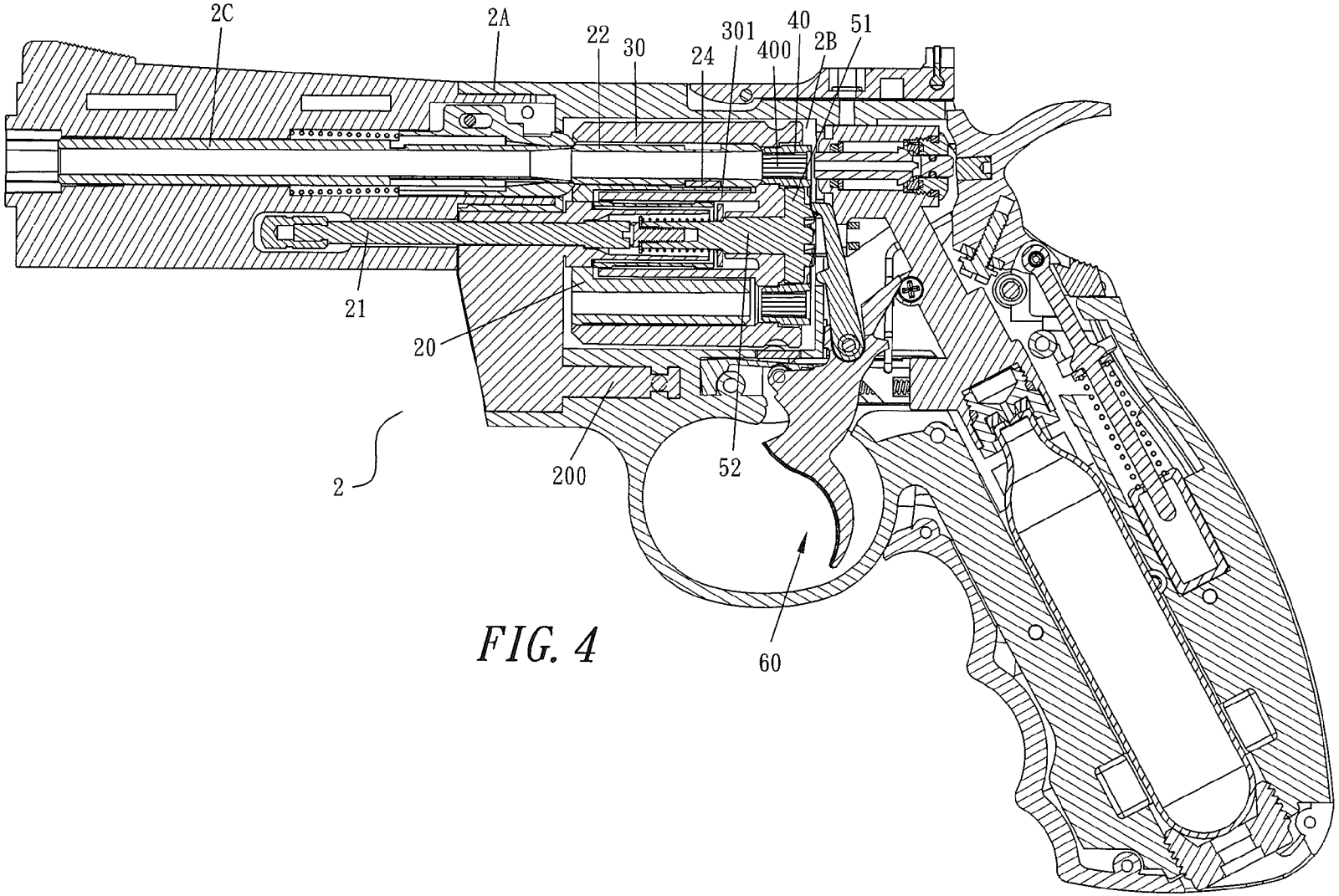
FIG. 4 is a sectional view of a preferred embodiment of the present invention.
Figure 5:
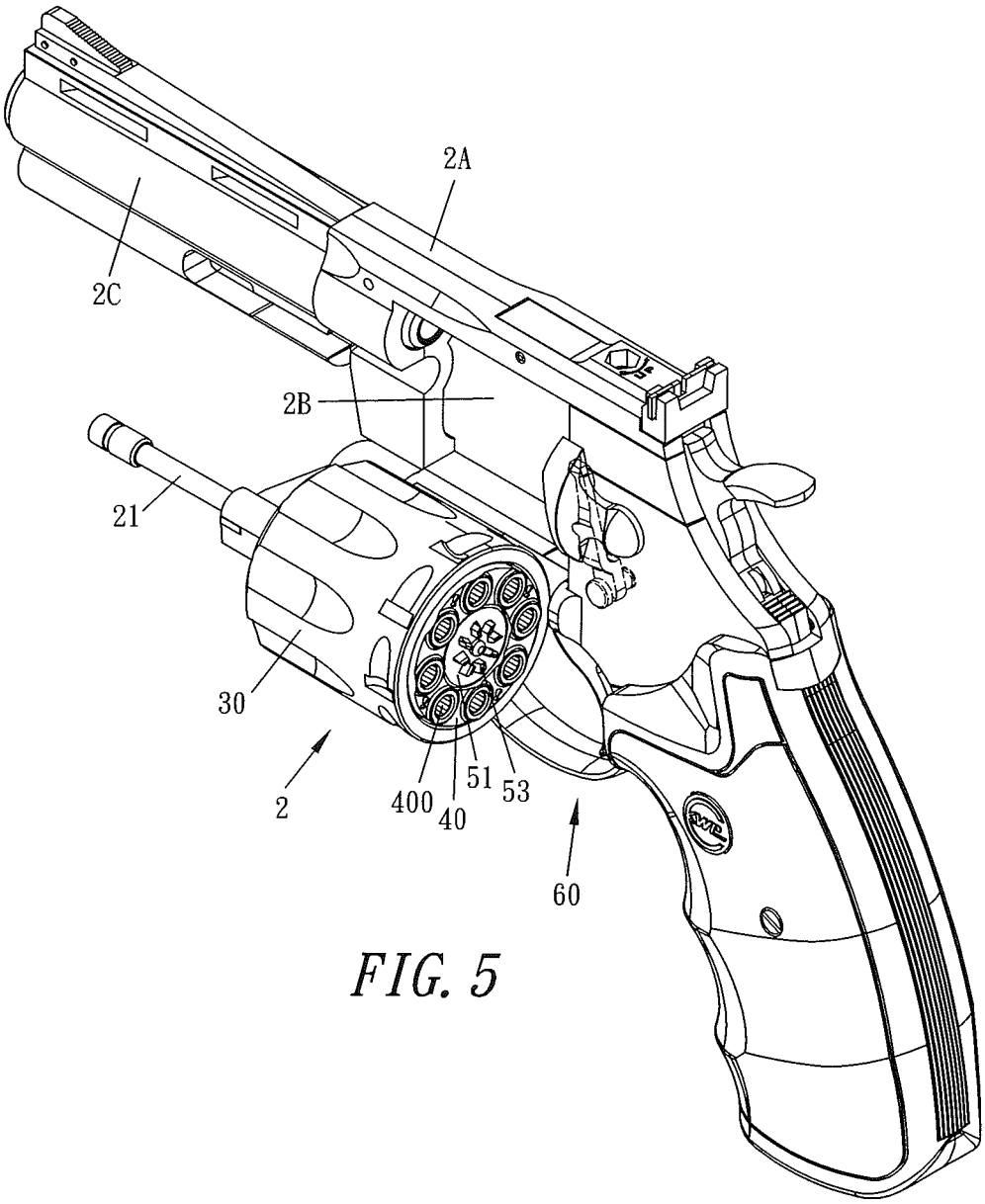
FIG. 5 is a perspective view of a preferred embodiment of the present invention with a magazine being flipped and removed.
Figure 7:
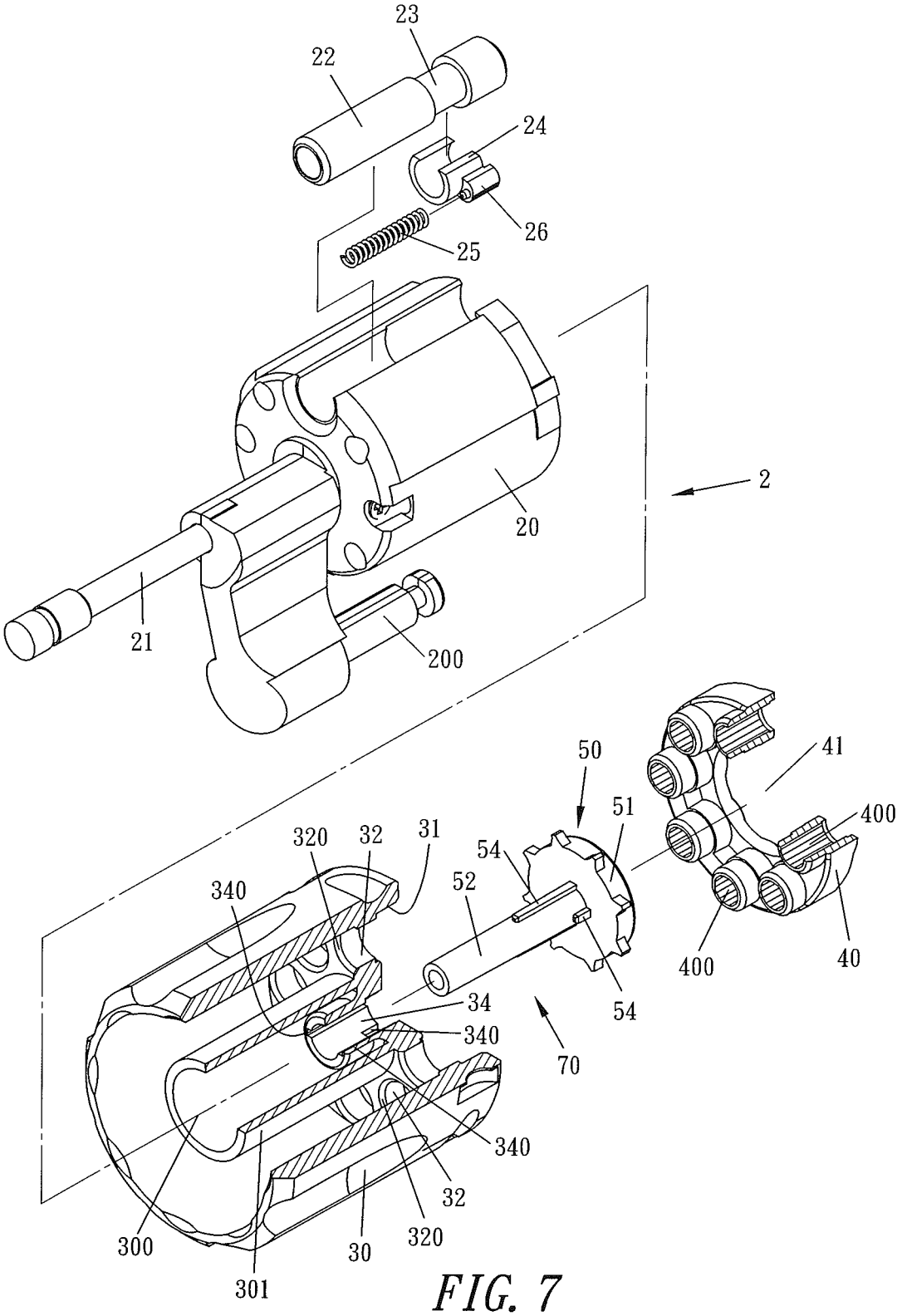
FIG. 7 is a first exploded view of a cartridge loading mechanism of a preferred embodiment of the present invention.
Figure 10:
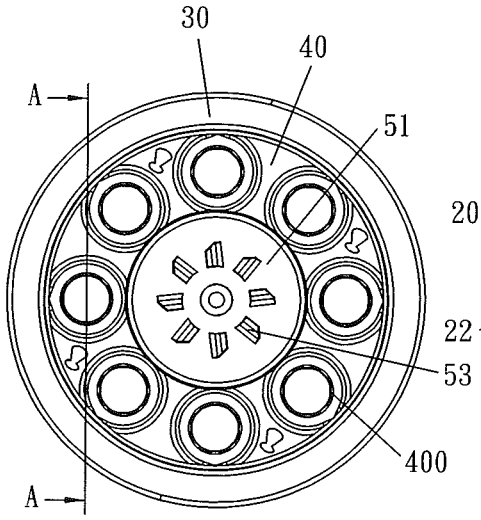
FIG. 10 is a front view showing a chamber aligned precisely with an inner magazine tube in accordance with a preferred embodiment of the present invention.
Figure 11:
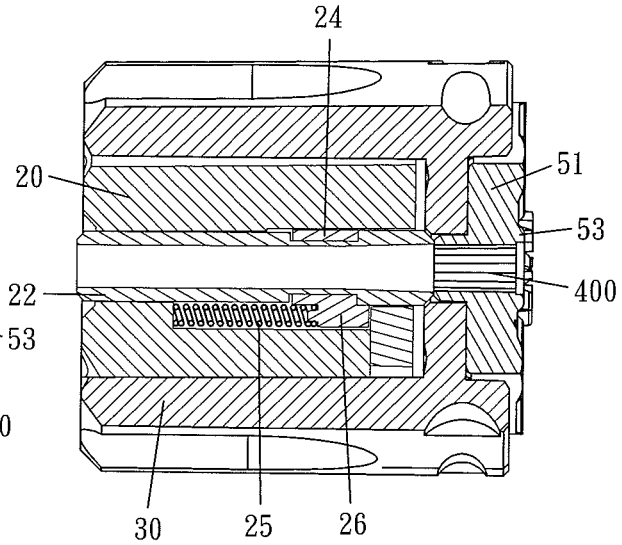
FIG. 11 is a sectional view of Section A-A as depicted in FIG. 10.

With reference to FIGS. 3 to 8 for a cartridge loading mechanism of a toy revolver 2 in accordance with a preferred embodiment of the present invention, the cartridge loading mechanism comprises the following elements:

A magazine 20 has a center supported and fixed by a support shaft 21. The magazine is coupled to a pivot shaft 200 which is pivotally coupled to a gun body 2A, and also pivotally coupled into an opening 2B at the middle of the gun body 2A (as shown in FIG. 5), The magazine 20 can be flipped sideways and removed by using the pivot shaft 200 as an axis. The magazine 20 has an inner magazine tube 22 disposed at an eccentric position of the magazine 20 and extended axially, and an end is coupled to a barrel 2C inside the gun body 2A. The inner magazine tube 22 has a neck portion 23 (as shown in FIG. 7) provided for accommodating a plastic inner magazine tube fitting 24 with an opening facing upward. The inner magazine tube fitting 24 has a spring seat 26 installed to a side of the inner magazine tube fitting 24 and a spring 25 with an end coupled to the spring seat 26 and the other end coupled to an inner wall of the magazine 20, so that the inner magazine tube 22 is pushed by the spring 25 to move away from an end of the barrel 2C (as shown in FIGS. 10 and 11).

Figure 6:
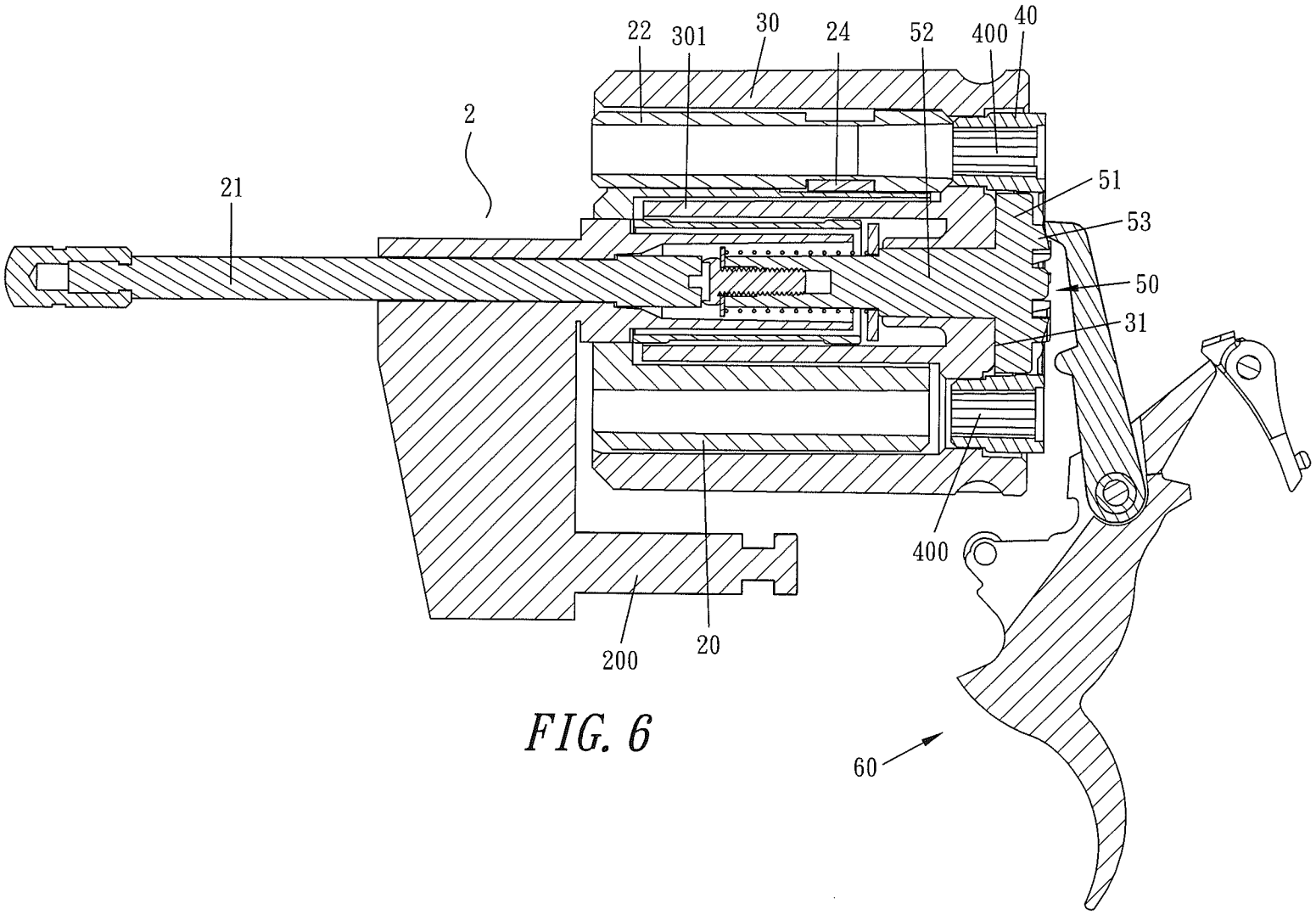
FIG. 6 is a sectional view of a cartridge loading mechanism of a preferred embodiment of the present invention.
Figure 8:
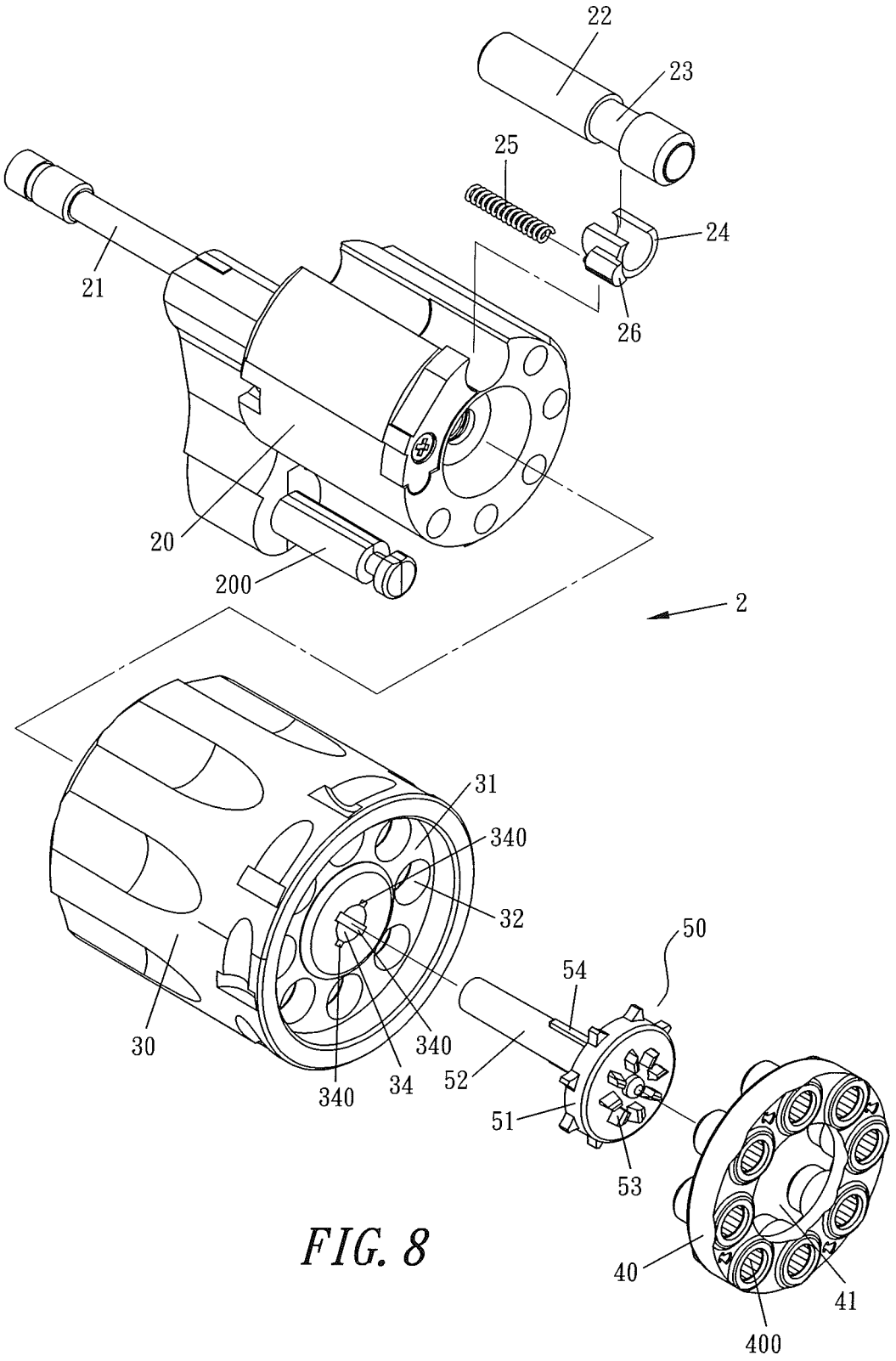
FIG. 8 is a second exploded view of a cartridge loading mechanism of a preferred embodiment of the present invention.
Figure 9:
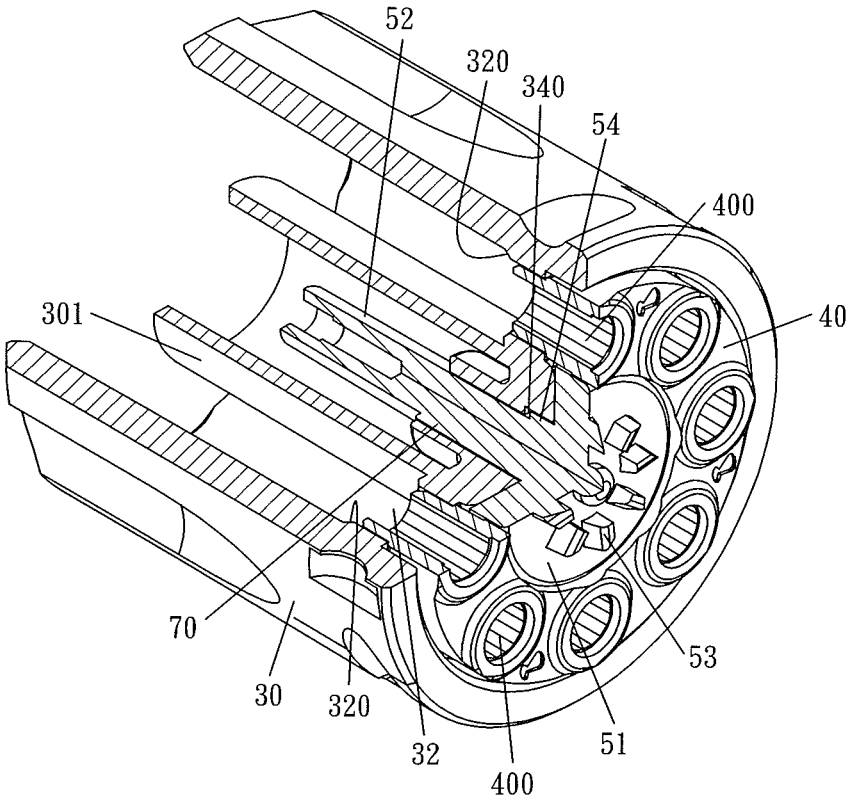
FIG. 9 is a sectional view of a cylinder, a cartridge drum and a driving element of a preferred embodiment of the present invention.

A cylinder 30 is sheathed on the magazine 20 and has a hollow shaft tube 301 disposed at the middle of the interior of the cylinder 30, and the shaft tube 301 is embedded from an end of the magazine 20. The magazine 20 is disposed in the cylinder 30 and outside the shaft tube 301, such that a pivoting relation exists between the cylinder 30 and the magazine 20. When the cylinder 30 is driven to rotate, the magazine 20 is used as an axis of rotation. The cylinder 30 has a containing slot 31 formed near a trigger 60, and the inner bottom of the containing slot 31 has a plurality of ports 32 circumferentially arranged by using a cylinder center 300 of the cylinder 30 as the center and facing a distal opening of the inner magazine tube 22, and the rim is a push-pull rim 320. When the cylinder 30 rotates to a specific point, one of the ports 32 is corresponsive to the inner magazine tube 22. A penetrating hole 34 is formed at the middle of the containing slot 31 (as shown in FIGS. 6 to 8), and the inner wall of the penetrating hole 34 has a plurality of key slots 340.

A cartridge drum 40 is embedded into the containing slot 31 of the cylinder 30, and a plurality of hollow chambers 400 is configured to be corresponsive to the ports of the cylinder 30 and extended into the ports 32 respectively. The chambers 400 are embedded into the ports 32 respectively, so that the cartridge drum 40 and the cylinder 30 are linked together. A toy bullet is loaded into each of the chambers 400. A through hole 41 is formed at the center of the cartridge drum 40 (as shown in FIGS. 6~8).

A driving element 50 is embedded into the through hole 41 and includes a drive seat 51 and a drive shaft 52. The drive seat 51 has a plurality of bumps 53 formed near the trigger 60 and circumferentially arranged, and the bumps 53 are driven the trigger 60 sequentially, so that the driving element 50 rotates in a certain angle. The drive shaft 52 is disposed at an end of the drive seat 51 with the back facing the trigger 60, and a distal portion is passed into the penetrating hole 34. An axial outer wall of the drive shaft 52 has a plurality of pins 54 protruded from positions corresponsive to the key slots 340 respectively. Each pin 54 is embedded into the respective key slot 340, and the key slot 340 and the pin 54 form an interlocking mechanism 70 as shown in FIG. 7, so that the driving element 50 is capable of driving the cylinder 30 (together with the cartridge drum 40) as shown in FIGS. 6 to 8.

When the driving element 50 is driven by the trigger 60 to rotate, the driving element 50 will drive the cylinder 30 to rotate together. Since the chambers 400 are embedded into the ports 32, the cylinder 30 can be linked and rotated together with the cartridge drum 40. However, when the cylinder 30 rotates, the magazine 20 supported by the support shaft 21 remains still.

Figure 12:
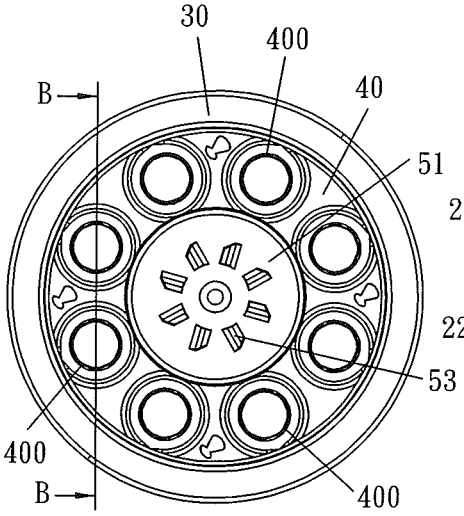
FIG. 12 is a front view showing a chamber not aligned precisely with an inner magazine tube in accordance with a preferred embodiment of the present invention.
Figure 13:
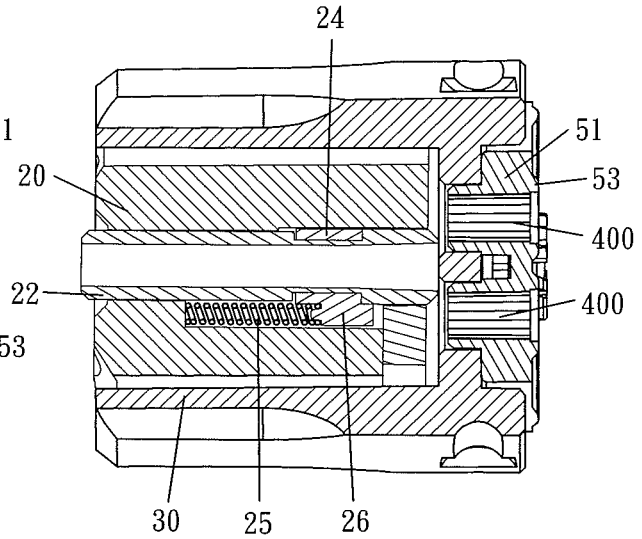
FIG. 13 is a sectional view of Section B-B as depicted in FIG. 12.

In FIGS. 10 to 14, when the trigger 60 is pulled, the trigger 60 drives the bump 53 to synchronously drive the driving element 50 to rotate one graduation. While driving the cylinder 30, the cartridge drum 40 is synchronously rotated by one graduation, shooting a bullet in the chamber 400 of the cartridge drum 40 to the outside. When the trigger 60 is pulled again, the cartridge drum 40 is driven to rotate. Before the cartridge drum 40 shifts from the previous chamber 400 to the next chamber 400 to align with the inner magazine tube 22, the cylinder 30 is rotated. Thus, the inner magazine tube 22 may be removed along the push-pull rim 320 of the port 32 and pushed by the wall of the containing slot 31 facing the inner magazine tube 22 to compress the spring 25 to retract in an axial direction (as shown in FIGS. 12 and 13) to the next port 32 of the cylinder 30. The chamber 400 is aligned with the inner magazine tube 22, and the spring 25 further pushes the inner magazine tube 22 back to connect the port 32 of the cylinder 30 and the chamber 400 (as shown in FIGS. 10 and 11), so that when the bullet is fired, the chamber 400 is aligned precisely with the inner magazine tube 22. Since the inner magazine tube 22 does not rotate with the cylinder 30, the inner magazine tube 22 will not have any gap or misalignment issues caused by rotation or and will not result in a poor shooting accuracy. When the bullet is fired, the inner magazine tube 22 is always aligned precisely with the barrel 2C in an axial direction, to improve the shooting accuracy. When in use, the cylinder 30 rotates with the driving element 50 and the cartridge drum 40, and the cartridge loading mechanism 2 can be removed by using the pivot shaft 200 as an axis for loading bullets. Thus, the degree of simulation is high.

In summation, the present invention has the following advantages:

1. The cylinder can rotate, and the cartridge loading mechanism can be removed by using the pivot shaft as an axis, so that the degree of simulation is high.

2. When a bullet is fired, the magazine and the inner magazine tube remain still, so that the trajectory will not be deviated during the shooting, and so that the shooting accuracy will be high.

While the invention has been described by means of specific embodiments, numerous modifications and variations could be made thereto by those skilled in the art without departing from the scope and spirit of the invention set forth in the claims.

What is claimed is:

1. A cartridge loading mechanism of a toy revolver, installed in an opening at a middle of a gun body, and pivoted to the gun body by a pivot shaft, with the cartridge loading mechanism being moved laterally out from the gun body and comprising:

a magazine having an end coupled to a support shaft, wherein the support shaft is adapted to be coupled to the gun body;

an inner magazine tube, axially installed at an eccentric position, and having an end adapted to be coupled to a barrel of the gun body;

a cylinder sheathed on the magazine, and having a containing slot formed proximate to an end with a trigger, with a plurality of ports formed at a bottom of an inner groove of the containing slot and arranged circumferentially by using a cylinder center of the cylinder as a center, with the plurality of ports configured to be corresponsive to the inner magazine tube when the cylinder is rotated;

a cartridge drum embedded into the containing slot, configured to be corresponsive to the plurality of ports, and having a plurality of hollow chambers extended into the plurality of ports, with the cartridge drum and the cylinder being linked with each other, with a toy bullet being loaded into each of the plurality of hollow chambers; and a driving element, disposed on a side of the cylinder proximate to the trigger, and including a drive seat and a drive shaft;

a plurality of bumps, formed on a side of the drive seat configured to be corresponsive to the trigger, and arranged into a circle by using a center of the drive seat, with the plurality of bumps driven by the trigger to rotate; and an interlocking mechanism coupling an end of the drive shaft with the cylinder to drive the cylinder to rotate together, wherein the interlocking mechanism has a penetrating hole formed at a middle of the containing slot, a plurality of key slots concavely formed on an inner wall of the penetrating hole; and a pin protruded from an outer shaft wall of the drive shaft and at a position corresponsive to one of the plurality of key slots, with the pin being embedded into the one of the plurality of key slots.

2. The cartridge loading mechanism of a toy revolver according to claim 1, wherein the cylinder has a hollow shaft tube disposed at a middle of an interior of the cylinder, wherein the magazine is disposed in the cylinder and outside the shaft tube, and wherein a pivoting relation exists between the cylinder and the magazine.

3. The cartridge loading mechanism of a toy revolver according to claim 2, wherein the inner magazine tube has a neck portion provided for accommodating a plastic inner magazine tube fitting with an opening facing upward, with a spring seat disposed on a side of the inner magazine tube fitting, wherein a spring has an end coupled to the spring seat and the other end coupled to an inner wall of the magazine, and wherein the spring provides a force for pushing the inner magazine tube to move towards the cartridge drum.

4. The cartridge loading mechanism of a toy revolver according to claim 3, wherein the port faces the inner magazine tube and has a rim which is a push-pull rim.

5. The cartridge loading mechanism of a toy revolver according to claim 1, wherein the cartridge drum has a through hole formed at a center of the cartridge drum and embedding the drive seat.

6. A cartridge loading mechanism of a toy revolver, installed in an opening at a middle of a gun body, and pivoted to the gun body by a pivot shaft, with the cartridge loading mechanism being moved laterally out from the gun body and comprising:

a magazine having an end coupled to a support shaft, wherein the support shaft is adapted to be coupled to the gun body;

an inner magazine tube, axially installed at an eccentric position, and having an end adapted to be coupled to a barrel of the gun body;

a cylinder sheathed on the magazine, and having a containing slot formed proximate to an end with a trigger, with a plurality of ports formed at a bottom of an inner groove of the containing slot and arranged circumferentially by using a cylinder center of the cylinder as a center, with the plurality of ports configured to be corresponsive to the inner magazine tube when the cylinder is rotated;

a cartridge drum embedded into the containing slot, configured to be corresponsive to the plurality of ports, and having a plurality of hollow chambers extended into the plurality of ports, with the cartridge drum and the cylinder being linked with each other, with a toy bullet being loaded into each of the plurality of hollow chambers; and a driving element, disposed on a side of the cylinder proximate to the trigger, and including a drive seat and a drive shaft;

a plurality of bumps, formed on a side of the drive seat configured to be corresponsive to the trigger, and arranged into a circle by using a center of the drive seat, with the plurality of bumps driven by the trigger to rotate; and an interlocking mechanism coupling an end of the drive shaft with the cylinder to drive the cylinder rotate together, wherein the cylinder has a hollow shaft tube disposed at a middle of an interior of the cylinder, wherein the magazine is disposed in the cylinder and outside the shaft tube, and wherein a pivoting relation exists between the cylinder and the magazine.

7. The cartridge loading mechanism of a toy revolver according to claim 6, wherein the inner magazine tube has a neck portion provided for accommodating a plastic inner magazine tube fitting with an opening facing upward, with a spring seat disposed on a side of the inner magazine tube fitting, wherein a spring has an end coupled to the spring seat and the other end coupled to an inner wall of the magazine, and wherein the spring provides a force for pushing the inner magazine tube to move towards the cartridge drum.

8. The cartridge loading mechanism of a toy revolver according to claim 7, wherein the port faces the inner magazine tube and has a rim which is a push-pull rim.

* * * * *